US005574422A

United States Patent [19]

Martin

[11] Patent Number: 5,574,422

[45] Date of Patent: Nov. 12, 1996

[54] MULTI-FUNCTIONAL VOLLEYBALL TALKING SCOREKEEPER

[76] Inventor: Steven D. Martin, 628 Enos Ct., Santa Clara, Calif. 95051

[21] Appl. No.: 513,707

[22] Filed: Aug. 11, 1995

[51] Int. Cl.[6] ..... G08B 23/00

[52] U.S. Cl. ..... 340/323 R; 377/5; 364/411

[58] Field of Search ..... 340/323 R; 377/5; 364/411

[56] References Cited

U.S. PATENT DOCUMENTS 4,097,855 6/1978 Salvo ..... 340/323 R 4,237,372 12/1980 Zavgolis ..... 340/323 R 4,491,954 1/1985 Gennit ..... 377/5

*Primary Examiner*—Jeffery Hofsass

*Assistant Examiner*—Mohammed R. Ghannam

*Attorney, Agent, or Firm*—The Kline Law Firm

[57] ABSTRACT

An automated scorekeeping device for volleyball or other games that includes an audible announcing system so that players are audibly informed of any changes in the score or serving team. The device may further include a visual display. Remote control actuators can be provided to one or more people to operate the scorekeeping device. The scorekeeper can be adjusted manually to correct mistakes, and can be used in multiple modes.

18 Claims, 10 Drawing Sheets

(audio only)

(top view of volleyball court)

(top view of volleyball court)

(top view)

side view front view (type 1)
90
901
902
903
904
905
906
907
908
92
TALKING
SCORE
KEEPER
RoxMar (type 2)
9010
901
903
904
906
907
908
94
TALKING
SCORE
KEEPER
RoxMar (type 3)
9020
901
903
904
906
907
908
909
96
TALKING
SCORE
KEEPER
RoxMar

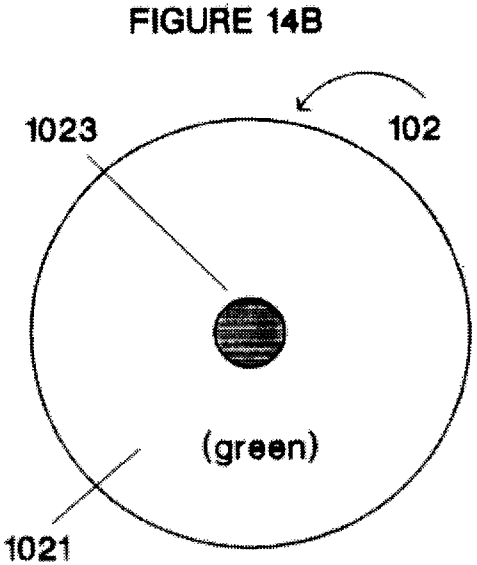
FIGURE 14B
FIGURE 14A
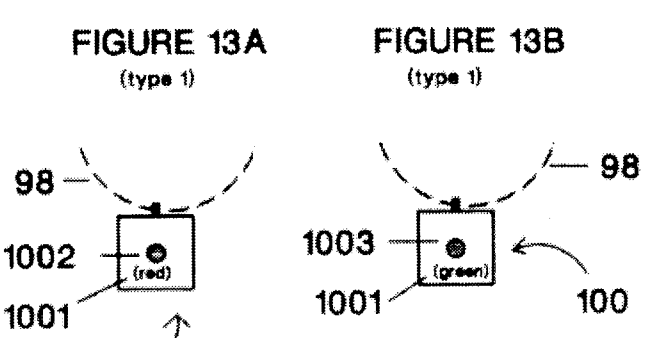
FIGURE 13B
(type 1)
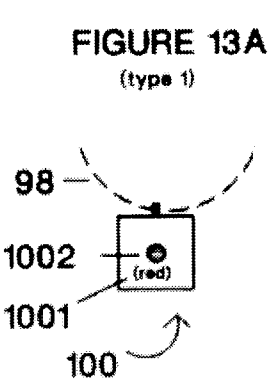
FIGURE 13A
(type 1)
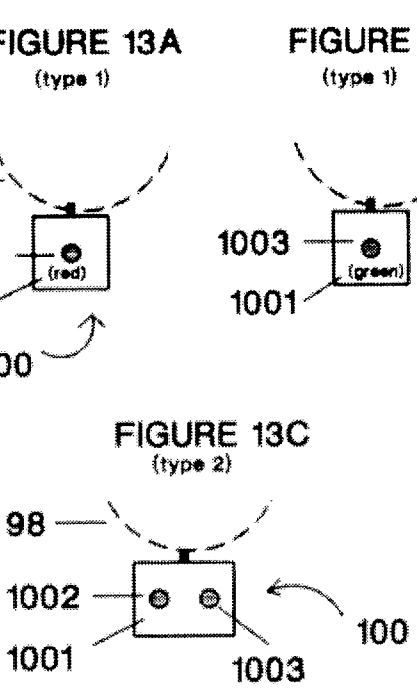
FIGURE 13C
(type 2)
FIGURE 13D
(type 3)
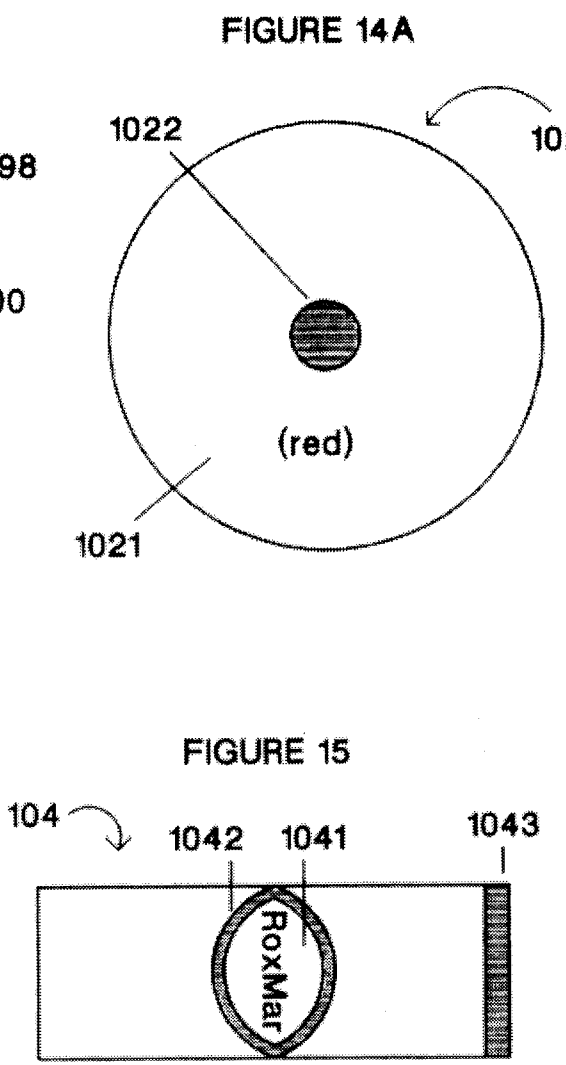
FIGURE 15
FIGURE 16

MULTI-FUNCTIONAL VOLLEYBALL TALKING SCOREKEEPER

FIELD OF THE INVENTION

The present invention relates generally to sports equipment, and more particularly is an automated means of keeping score for a volleyball game.

BACKGROUND OF THE INVENTION

Volleyball is a very popular sporting activity. Because of the widespread appeal of the game, informal "pickup" games occur at a variety of locales. Pickup games are very common at beaches and in gymnasiums.

A common problem in pickup games is that there is no non-participating scorekeeper. This can lead to many problems. Volleyball has a somewhat complicated method of scoring in which points are only awarded to the serving team. This can mean that many serves can be put into play with no change in the score. Although players are required to announce the score before each serve, confusion can be generated in long rallies or when changing serving teams. In addition to honest mistakes in the actual score of a game, a more scurrilous player may intentionally misstate the score.

Disagreements in the score are a common cause of arguments in pickup games, and can easily lead to arguments and decreased enjoyment of the game. In the worst case, games may be cancelled because of these disagreements.

Because of the expense of having an impartial scorekeeper, that solution is rarely if ever available to the pickup player. Inexpensive score displays are available, but the same problems with confusion of score can arise with these manual devices. It is simply too inconvenient for a player to periodically interrupt the game to update a scoreboard. Similarly, to date there has been no available automated device that has a selling price low enough to make it readily available to the pickup player.

OBJECTS, SUMMARY, AND ADVANTAGES OF THE INVENTION

Accordingly, it is an object of the present invention to provide a means for automatically keeping score of a volleyball game.

It is another object of the present invention to provide a device that audibly announces the score before each serve so that errors and incorrect scoring is noticeable by all players.

It is a further object of the present invention to provide a device that allows play to be continuous.

It is a still further object of the present invention to provide a device that has multiple options to allow the user to update the score.

It is another object of the present invention to provide a means to accurately and easily track the score of a game.

In summary, the present invention is an automated scorekeeping device for volleyball. The device includes a voice recorder so that players are audibly informed of any changes in the score or serving team. The device further includes a visual display. Remote control actuators are provided to one or more people to operate the scorekeeper. The scorekeeper can be adjusted manually to correct mistakes, and can be used in multiple modes.

An advantage of the present invention is that, prior to each serve, the score is audibly announced so that all players can track the score without visual monitoring. This provides a means to assure accurate and honest control of the score, even when the players themselves are responsible for the scorekeeping.

Another advantage of the present invention is that the score of a volleyball game can be kept accurately without interrupting the flow of the game.

A further advantage of the present invention is that the scorekeeper is small, lightweight, and easily installed on a volleyball net post.

A still further advantage of the present invention is that it is inexpensive to manufacture.

Yet another advantage of the present invention is that it can be utilized by players of all skill levels, and can also be utilized in organized games by the officials.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIGS. 13*a–d* show different configurations of a remote transmitter designed to be affixed to a chain worn by the user.

FIGS. 14*a–b* show both sides of the foot flip switch.

FIG. 15 is a top view of a wrist or ankle band remote transmitter.

FIG. 16 is a top view of a hand held remote transmitter.

BEST MODE OF CARRYING OUT THE INVENTION

The present invention is a volleyball talking scorekeeper (VTS) 10. The VTS comprises a user interface 12, a display board 14, and remote transmitters 16. Users activate the user interface 12 with the remote transmitters 16 to track play in a volleyball game.

Figure 5:
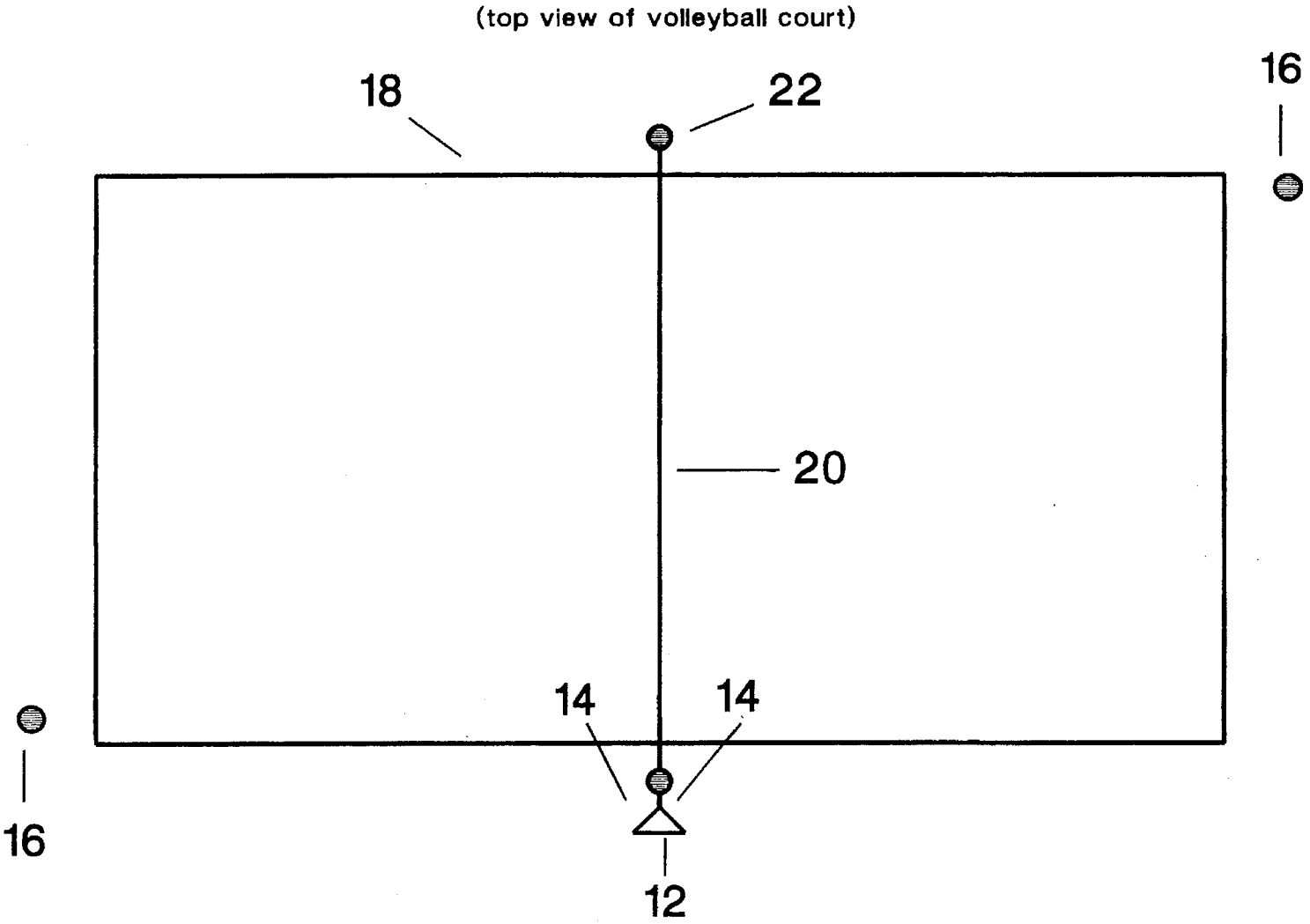
FIG. 5 shows the standard layout of a volleyball court with the scorekeeper with audio and visual outputs installed, and utilizing remote foot flip switches.
Figure 6:
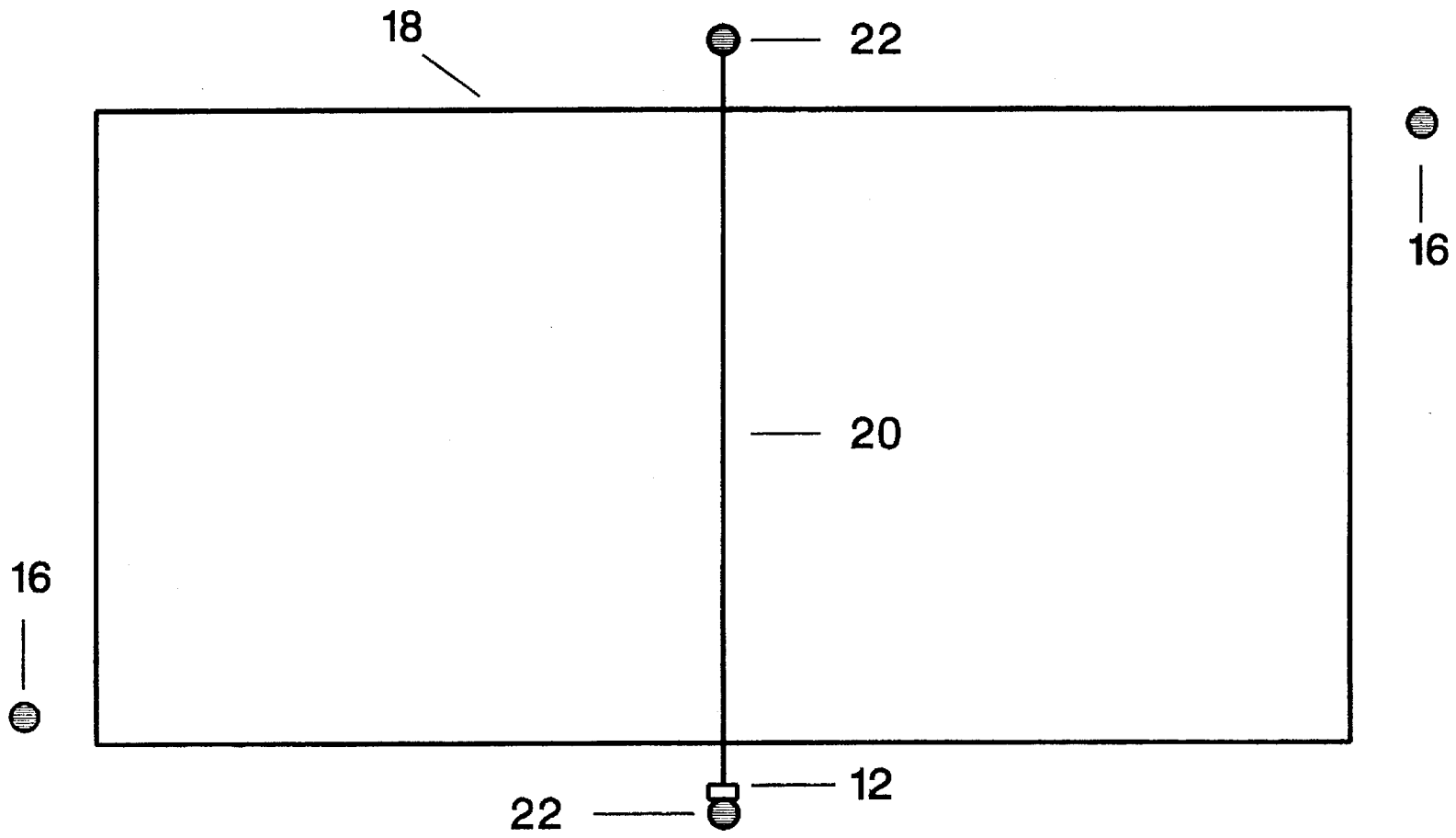
FIG. 6 shows the standard layout of a volleyball court with the scorekeeper with audio output only installed, and utilizing remote foot flip switches.
Figure 7:
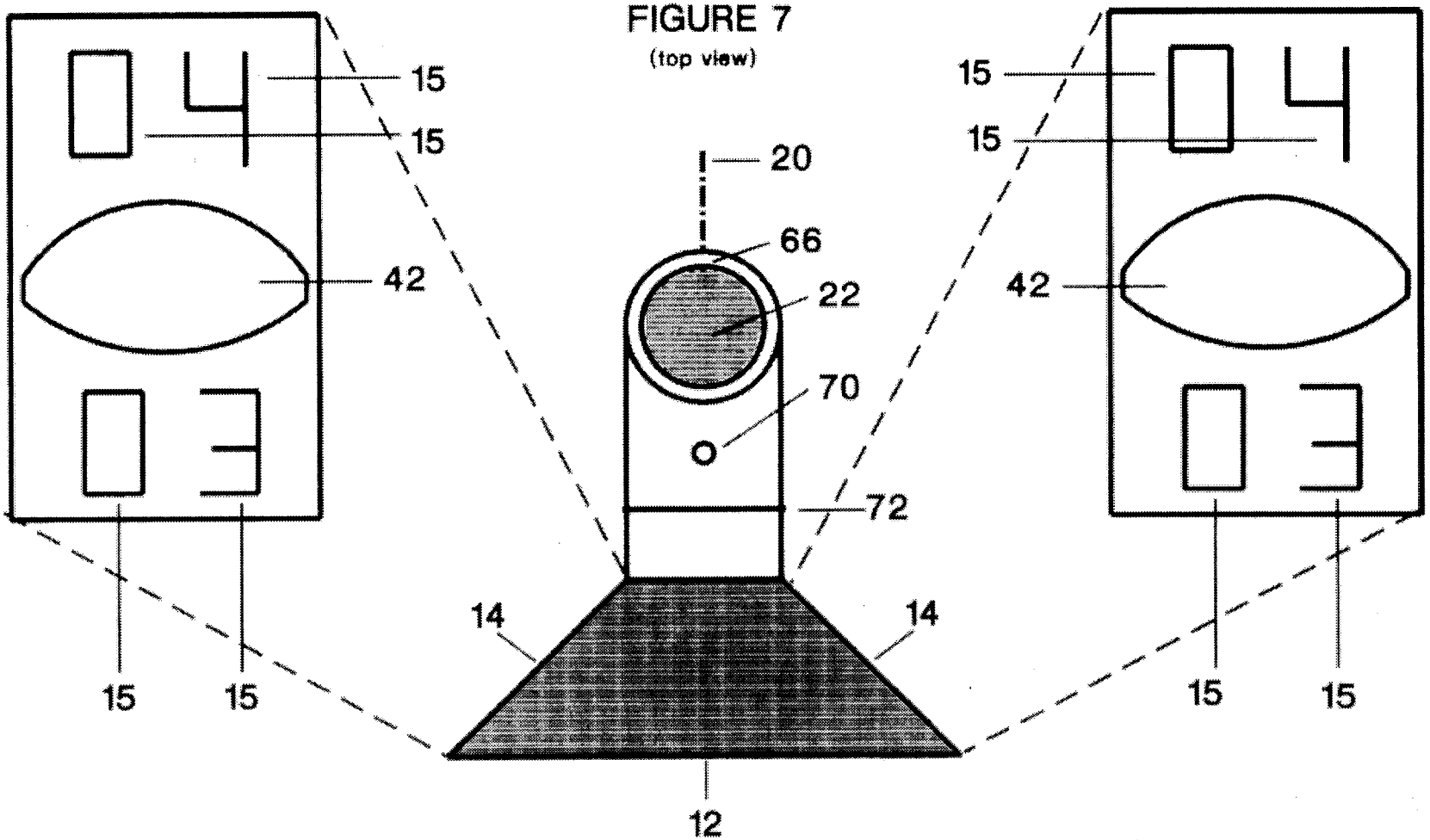
FIG. 7 is a top view of the display board affixed to a net post.

FIGS. 5 and 6 illustrate an overhead view of the layout of a volleyball court with the VTS 10 installed. FIG. 5 shows the VTS 10 with audio and visual display, FIG. 6 shows the VTS 10 with audio output only.

The boundaries of the volleyball court are defined by a perimeter rope 18. A net 20 is supported by two net poles 22 at a centerline of the court. The user interface 12 and display 14 are mounted on one of the net poles 22. Remote transmitters 16 are required if a non-participating scorekeeper is not being utilized.

Figure 1:
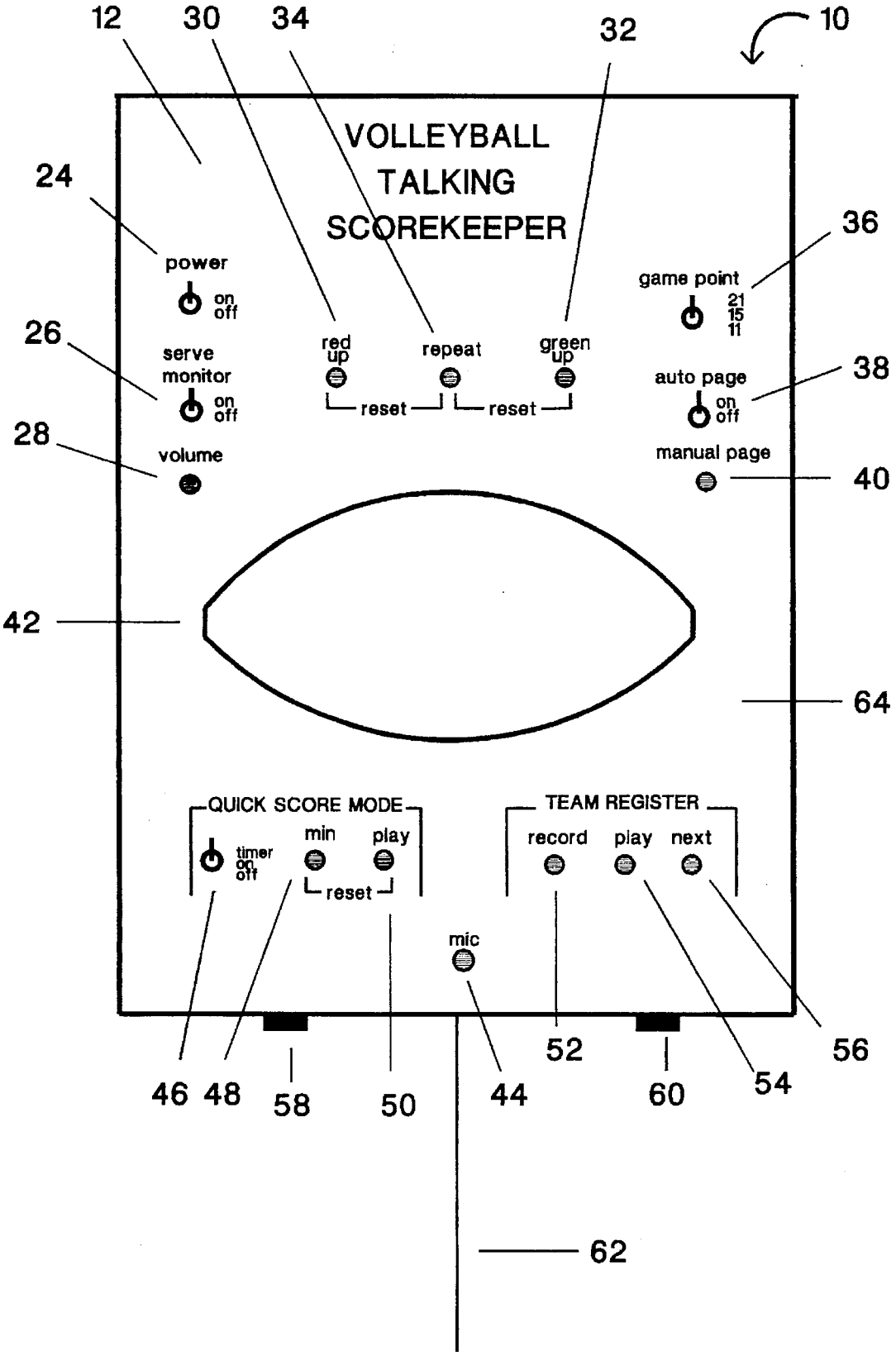
FIG. 1 is a front view of the user interface of the scorekeeper of the present invention.

The user interface 12 is shown in detail in FIG. 1. The operation of the various functions controlled by the user interface 12 will be discussed in detail below. The user interface 12 includes a power on/off switch 24, a serve monitor on/off switch 26, and a volume control 28. A first team score button 30 and a second team score button 32 control the score displayed for each team. A repeat 34 button is situated between the score buttons 30 & 32.

Further controls on the user interface 12 are a multi-position game point selector switch 36, an automatic page on/off switch 38, and a manual page button 40. A speaker 42 and a microphone 44 are mounted on the user interface 12 to enable the audio function of the VTS 10. Speakers 42 may also be mounted on the display boards 14.

An optional quick score mode includes a multi-position enabling switch 46, a timer set button 48, and a time announce button 50. An optional team register includes a record button 52, a play button 54, and a next button 56.

The user interface 12 can also be equipped with input 58 and output 60 jacks to receive wire remote inputs and to output to external speakers respectively. The user interface 12 is also equipped with an antenna 62 to receive signals from wireless remote transmitters.

Figure 2:
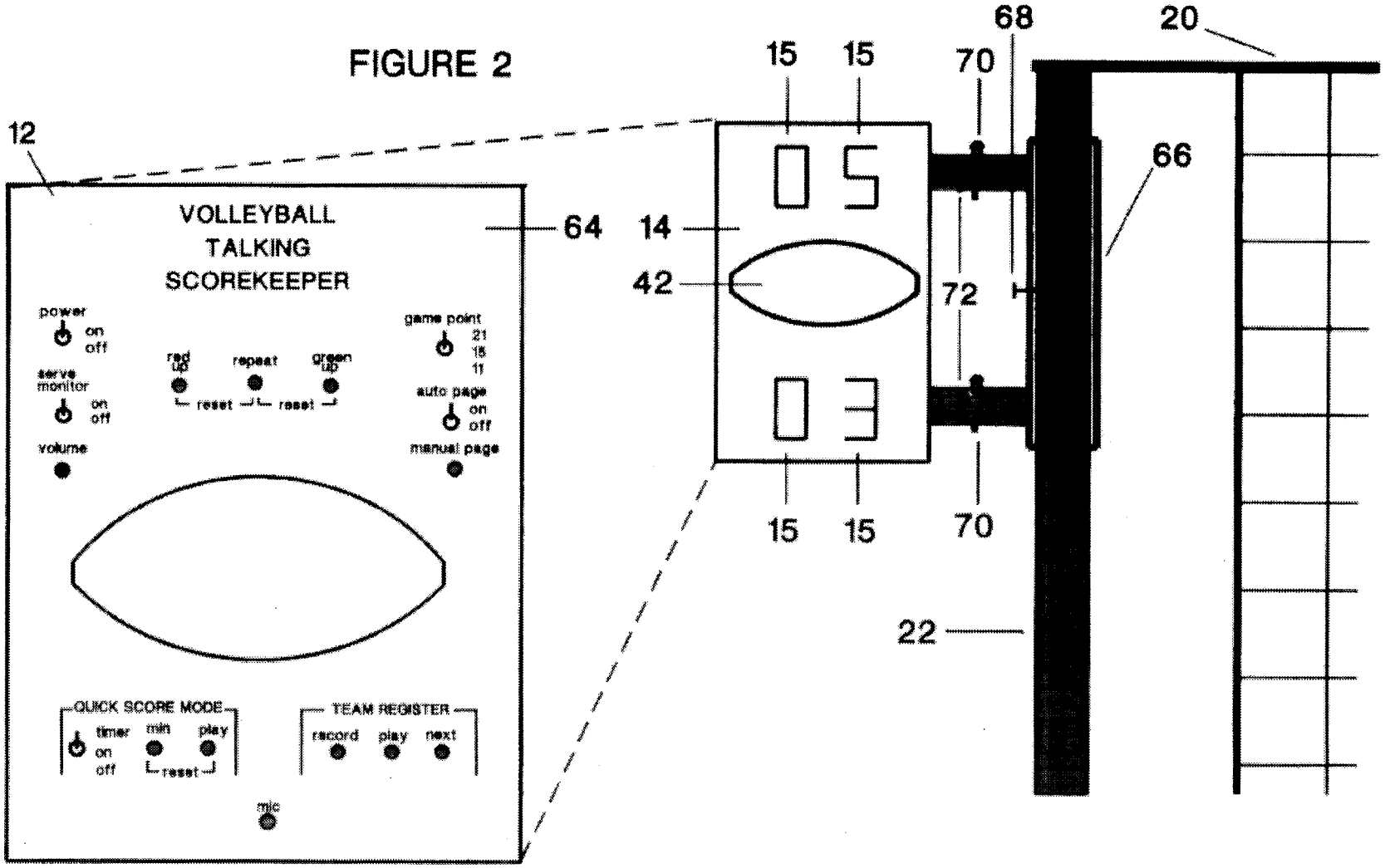
FIG. 2 is a view of the user interface with display board affixed to a net post.

FIG. 2 depicts an embodiment of the VTS 10 with both visual and audio output. A main housing 64 of the unit includes at least one display board 14 with digital display 15 on a side of the housing. Generally, it is envisioned that the unit will include a display board 14 on two sides, the displays being angled for easiest viewing by the players. A net pole adapter 66 includes an affixing member that is attached to the net pole 22. The adapter 66 is held in place by a thumb screw 68 or other securing means. Release pins 70 can be utilized in connecting arms 72 of the pole adapter 66 to allow removal of the main housing 64 while leaving the pole adaptor 66 in position for a later use.

Figure 3:
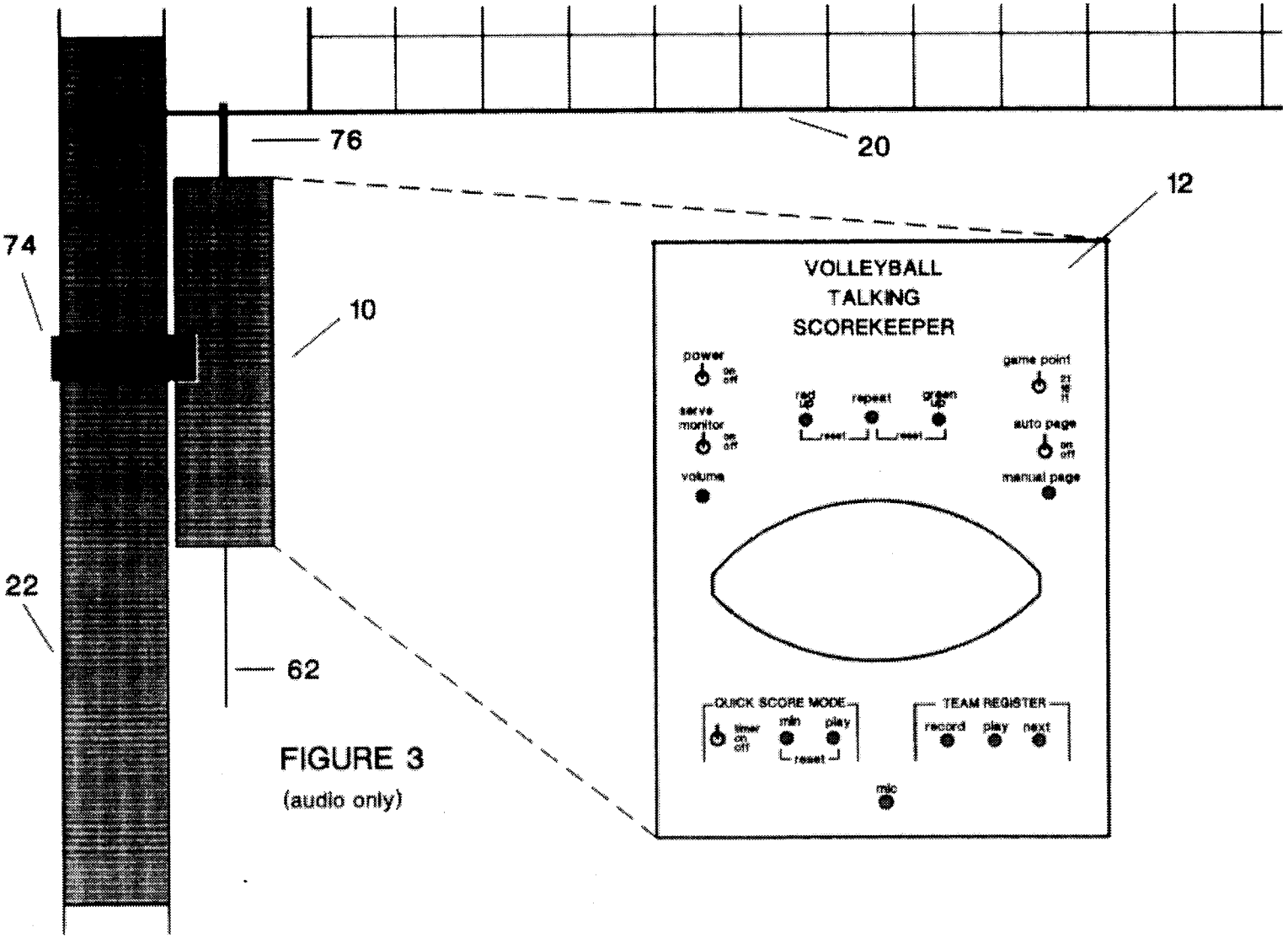
FIG. 3 depicts the scorekeeper with audio scoring only.

FIG. 3 show the VTS 10 audio only unit. Since this unit is much lighter and smaller, a strap 74 is used to hold the housing in place. The strap 74 will be secured by a hook and loop fastener such as Velcro, or by any other means desired by the user. To further secure the housing, a hook 76 is supplied to secure the housing to the net itself.

Figure 4:
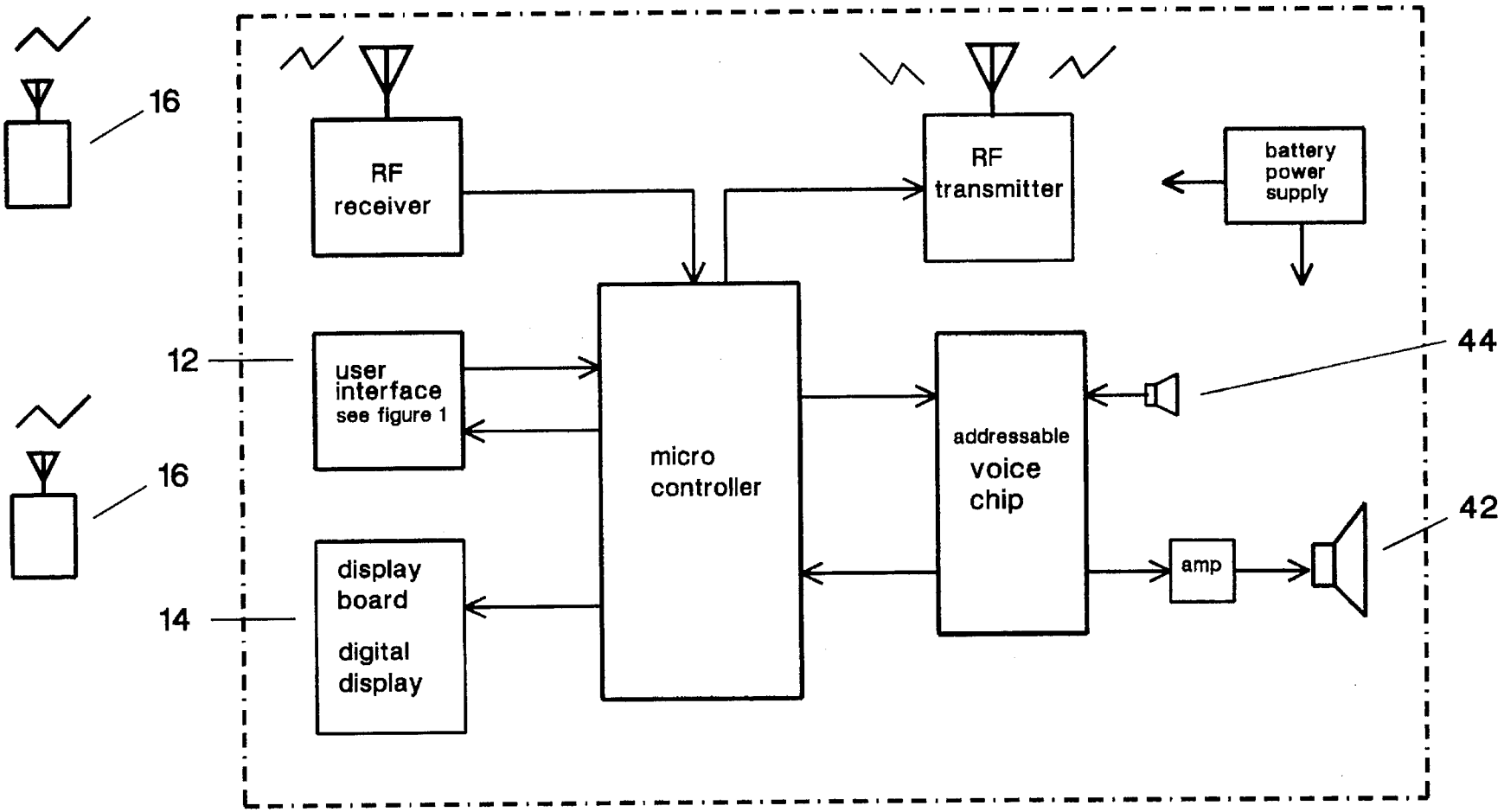
FIG. 4 is a schematic diagram of the scorekeeper of the present invention.

FIG. 4 shows the schematic operation of the VTS 10. Audio capability is provided by an addressable voice chip. The voice chip is used by the person assembling the device to record the necessary audible cues for a volleyball game. An end user is then able, using the functions of the VTS 10, to later output the signals required for scoring and tracking a team queue for a volleyball game. These voice chips are commercially available, and are therefore not described in detail herein. An example of voice chips acceptable for the present invention are the ISD 2500 family.

A microcontroller is utilized to control displays and to track inputs. The microcontroller is connected to the voice chip, the user interface 12, the optional display boards 14, and an RF receiver to communicate with the remote transmitters 16. The microphone 44 is used to record information on the voice chip, and the speaker 42 with an in-line amplifier provides the audio output.

Figure 9:
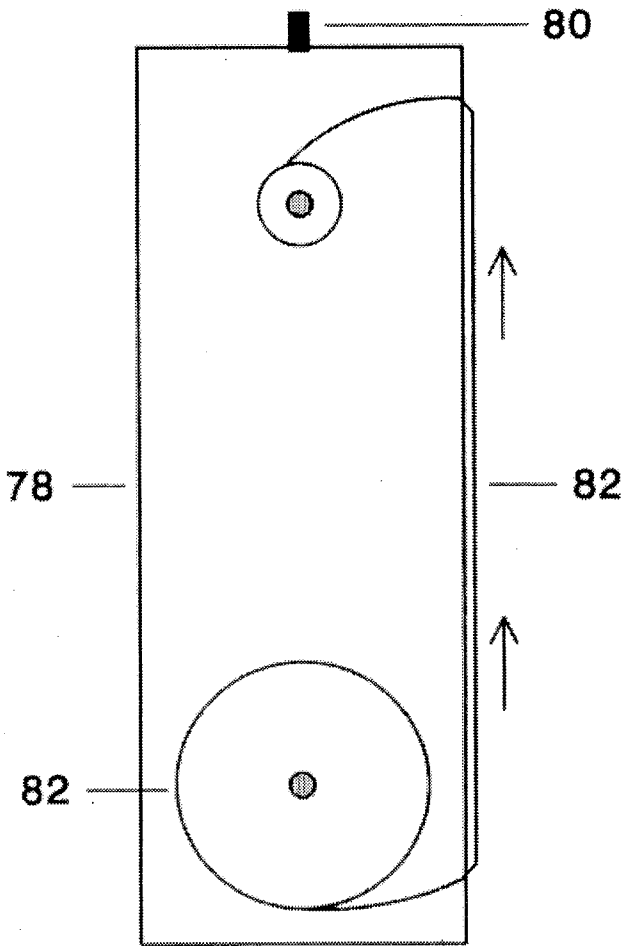
FIG. 9 is a side view of an optional scrolling signup list that is attached to the scorekeeper.
Figure 8:
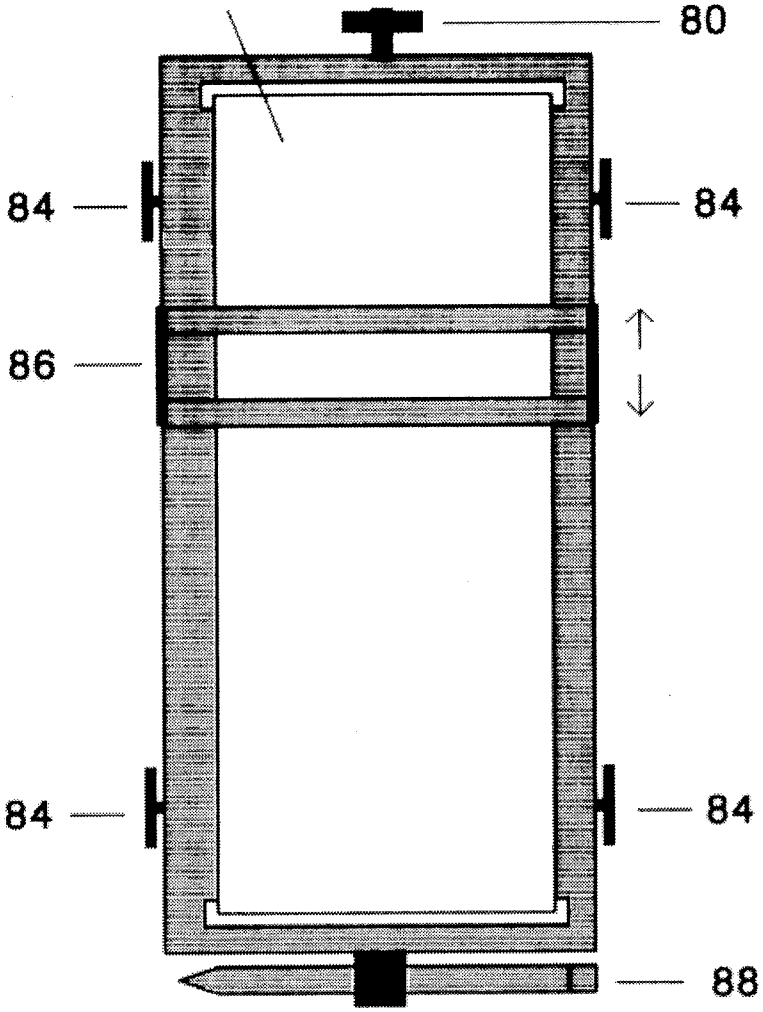
FIG. 8 is a front view of an optional scrolling signup list that is attached to the scorekeeper.

FIGS. 8 & 9 depict an optional scrolling signup sheet 78. The signup sheet includes a hook 80 to affix the signup sheet 78 to the VTS 10. A roll of paper 82 is provided for players to enter their names in order of waiting for the next game. The paper 82 is advanced by thumb wheels 84. A stencil guide 86 and a pencil 88 are provided to facilitate the players' signing up.

Figures 10, 11, 12:
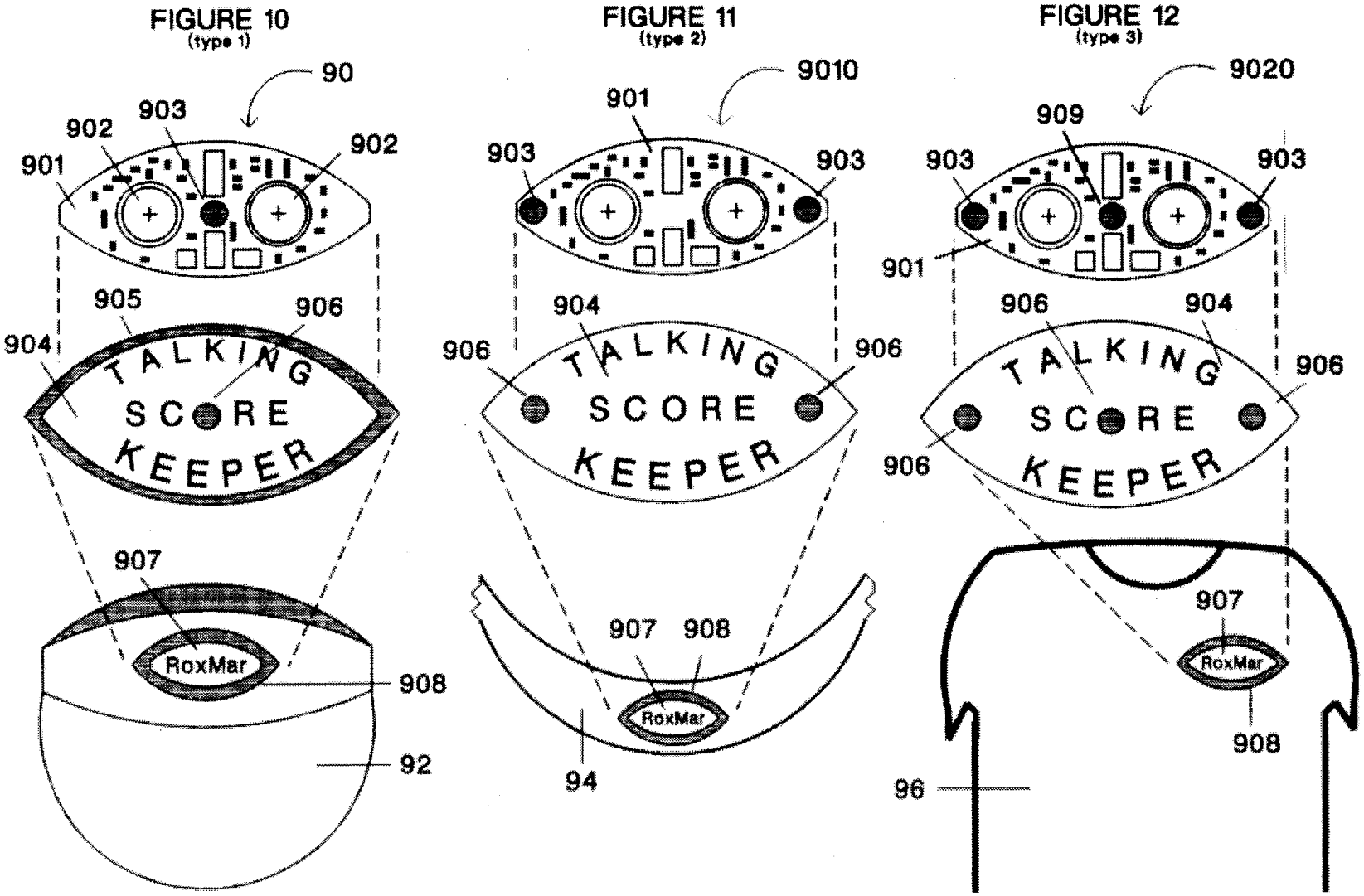
FIG. 10 depicts a first embodiment of a patch remote transmitter.
FIG. 11 depicts a second embodiment of a patch remote transmitter.
FIG. 12 depicts a third embodiment of a patch remote transmitter.

Various configurations for the remote transmitters 16 are shown in FIGS. 10–16. FIGS. 10–12 illustrate three embodiments of a patch transmitter. FIG. 10 illustrates a type one patch transmitter 90 affixed to a cap or visor 92.

The type one transmitter 90 includes a PCB 901 with the controlling logic. The transmitter 90 is powered by lithium batteries 902, and has a score control button 903 mounted on each side of the PCB 901. The PCB 901 is mounted inside a transmitter pouch 904. The pouch 904 includes a border with a fastening means 905. The fastening means will generally be a hook and loop type fastener such as Velcro. The area 906 on the pouch 904 covering the score control button 903 will be colored red or green to differentiate the two sides of the transmitter by team.

The type one remote transmitter is used when all the players are controlling the score form the serving position. The remote can be reversed if necessary when changing teams.

The pouch 904 is then installed on a receiving patch 907. The receiving patch includes a fastening means 908 that mates with the fastening means 905 on the transmitter pouch 904 to secure the transmitter in place. The receiving patch 907 is affixed to any article of clothing desired by the user. FIG. 10 illustrates the receiving patch 907 affixed to a cap 92, while FIG. 11 shows a headband 94, and FIG. 12, a shirt 96.

FIG. 11 illustrates a type two patch transmitter 9010. The type two patch transmitter 9010 includes the same components as the type one transmitter 90, but both score control buttons are affixed to one side of the transmitter 9010. This enables the user to access the score control buttons for both teams without reversing the pouch 904.

FIG. 12 shows a type three patch transmitter 9020. The type three patch transmitter 9020 includes a repeat button 909 to allow further control by the user of the score announcing. (This function, as well as all functions of the VTS are discussed in detail below following the description of the construction of the devices.)

FIGS. 13*a–d* illustrate an embodiment of a remote transmitter 100 that is designed to be affixed to a chain or cord 98 worn by the user. This device, like the patch transmitters, come in types one, two and three. FIGS. 13*a–b* illustrate the type one transmitter with the PCB and batteries encased in a housing 1001. The type one transmitter includes a first scoring button 1002 on a first side and a second scoring button 1003 on a second side.

The type two transmitter includes scoring buttons for both teams. The type three transmitter includes both scoring buttons as well as a repeat button. The type two and type three remote transmitters 16 are used when one player is controlling the score for both teams. To simplify the scoring, the player keeping score always presses the first score button for their team and the second teams score button for the opposing team. The players would generally take turns scoring for complete games only because passing a remote between serves could delay the game. If a four player game is being played, then a player's turn to score would be once every eight games.

FIGS. 14*a–b* illustrate the foot flip switch 102. The foot flip switch 102 comprises a flat housing 1021 that will usually be constructed from a soft rubber material or the like. The housing 1021 is thick enough only to accommodate the PCB and batteries necessary for signal transmission. Alternatively, the foot flip switch could be linked to the microprocessor by wire. The wire would be routed through the interior of the perimeter rope 18 and connected to input jack 58.

The foot flip switch 102 is flat so that it can be laid on the ground or in the sand at either end of a volleyball court during a game. A first team score button 1022 is exposed on a first side of the switch, and a second team score button 1023 is exposed on a second side of the switch. The foot flip switch 102 is laid at each end of the court, and can be flipped over when the teams change sides so that the proper score button is always exposed to the server.

FIG. 15 illustrates a wrist or ankle band 104 modified to accept remote transmitters. The band 104 includes a receiving patch 1041 with a fastening means 1042 (generally a hook and loop type fastener such as Velcro) around its border. An affixing means 1043 (again, generally a hook and loop type fastener such as Velcro) secures the band 104 to the user's body.

It should be noted that the wrist/ankle bands 104 and the headbands 94 can be color coded so that the server can be easily identified. The bands can also be coded to distinguish between first and second servers, which is of particular utility when two-man games are being played.

FIG. 16 shows an embodiment of the remote transmitter 106 intended to be used by a referee. This transmitter is a type three transmitter including a housing 1061, a first team score button 1062, a second team score button 1063, and a repeat button 1064.

The operation of the VTS 10 provides all the functions necessary to score a volleyball game, and to track the turns of teams waiting to play. The audio output of the system can be up to six words, depending on the situation. The audio output is one of the chief distinguishing factors of the present invention as compared to all other available products. Audio scoring eliminates the need for players to visually track the scoreboard to discover errors and incorrect scoring.

Visual display boards provide the best method to reflect the score in a game that has an impartial scorekeeper, simply due to the fact that a continuous display is provided. However, when the score is player controlled, a visual display can be unreliable due to erroneous input. Other players must constantly monitor the display if a visual display only is used. For instance, the players would need to watch the person incrementing the score to be certain that the score was correctly changed.

The present invention with its audio output eliminates this problem by always announcing the score before a serve and locking out any other inputs. This makes the scoreboard (the VTS) a convenience to the players instead of a burden.

The audible cues installed in the voice chip in the VTS 10 by the manufacturer of the VTS are shown below in Table 1.

TABLE 1

| Word 1 | Word 2 | Word 3 | Word 4 | Word 5 | Word 6 |
|---|---|---|---|---|---|
| Double tone or Single tone or "Correction" | Blank or "Side out" or "Repeat" | Blank or "Game point" or "Deuce" | Serving team score "0" to "31" | "Serving" | Receiving team score "0" to "31" |

Operation of the device is as follows: The user activates the VTS 10 by enabling the power on/off switch 24. When this switch is turned to the on position, the score and all other functions are reset to zero, and any voice registered teams are erased.

Next, the serve monitor 26 is turned on if a two-man volleyball game is being scored. If the serve monitor is enabled, the device will output first a single tone and then a double tone to indicate first or second server. If the serve monitor is disabled as in normal play, then a single high-low tone sounds to announce each server. The VTS 10 will always sound a tone before a service to alert the receiving team. This tone performs the function normally performed by a referee's whistle at an officiated game.

The user must also set the game point switch 36 to choose the length of game desired. It is envisioned that games of 11, 15 or 21 points may be chosen. If the user chooses to enable the automatic page 38, the VTS 10 will automatically send a signal to a commercially available paging device to inform a waiting player of his approaching turn in the game. The signal is sent at a predetermined time, such as when the game score reaches game point minus two, or when quick score mode (discussed under optional features below) is activated. A paging signal can be sent at any time by activating the manual page button 40.

When the VTS is activated, both the first and second team scores are set to zero. The serving team presses their score button, either 30 or 32. (The score buttons 30 and 32 are generally color coded red and green to differentiate the teams. In this instance, we will assume that team one is serving.) The VTS, through the speaker 42, sounds the appropriate serve tone, and announce the score as "Zero serving zero". The ball is put into play, and the first serve played.

If the serving team, team one, wins the point, the server or scorekeeper presses the first team score button 30 to increment the score. The VTS 10 will then sound the serve tone, and announce the updated score, "One serving zero". If the receiving team wins the first serve, then the second team serve button is pressed. The VTS 10 will then, after the serve tone, announce "Side out, zero serving zero."

To prevent unintentional or intentional incorrect score addition, the VTS 10 locks out the team score button after a signal is received until the audio announcement of the score is completed. Therefore each score addition is announced to all present.

Play continues until game point is reached and won. The VTS 10 is programmed to track deuce scoring. If the repeat button 34 is activated, the correct score will be announced again. (The correct score is always announced after a team score button is activated.)

The VTS includes a correction mode that is activated by pressing the repeat 34 followed by a team score button 30 or 32. The VTS 10 will then announce "Correction", followed by the score, with the score button having decremented that team's score. Activating the repeat button 34 by itself will simply cause the VTS 10 to announce the current score.

All the necessary controls of the VTS 10 can be operated on either the user interface 12, or by one of the type three remote transmitters 16. The type one and type two remote transmitters lack the repeat function button.

If the visual display boards 14 are being utilized, the VTS 10 increments the score display as the team score button 30 or 32 is activated. When the VTS 10 is in use, all participants and spectators are informed of the correct score before each serve. Due to the audible function of the VTS 10, a player or spectator is not required to look at a scoreboard to see if the score is being kept correctly. This reduces the possibility of participants losing track of the correct score.

OPTIONAL FEATURES

QUICK SCORE MODE: The quick score mode can be used when a game is under time constraints. If quick score is enabled, a point is scored on every serve. The VTS can be set, by using the timer set button 48, to allow a given time for play under normal scoring, and then to activate the quick score mode. When the timer is activated, pressing the play button 50 causes the VTS 10 to announce the minutes remaining until quick score mode takes effect. When the timer expires, quick score mode is automatically enabled, and the VTS announces "Warning, starting quick score". Unless reset, the timer will automatically return to its original value for the next game.

TEAM REGISTER: The team register button 52 can be used, in conjunction with the microphone 44 to register waiting players and teams in a system queue upon the teams' arrival. The team is placed in the queue behind any previously registered teams. The registers on the voice chip that are required for the announcements of the VTS are of course not accessible by the microphone 44, but surplus addresses can be utilized to store the waiting team and player information. The VTS always automatically announces the next team in line at the end of a game. If a team fails to appear, the next button 56 can be activated to skip their place. Generally, a complete scoring cycle must be registered before the VTS will proceed to the next team. The play button 54 can be used for a complete listing of the waiting teams.

SCROLLING SIGNUP LIST: This manual device can be used in conjunction with or in place of the audible team register.

The VTS 10 is expected to greatly reduce the confusion, argument, and general hassle associated with volleyball game scoring, particularly informal games. While the device as disclosed above presumes the microcontroller has been programmed for volleyball, the principles and operation of the invention described herein can be adapted to different games. The device assembler can easily program the microcontroller for the scoring pattern required in other games. Minor variations might be required in the hardware conformation.

Accordingly, the above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A volleyball scorekeeping device comprising:

a microcontroller, an addressable voice chip that an assembler pre-records with audible signals to track and score a volleyball game, a user interface including controls that a user operates to input information to said device, and a speaker means to provide audible output; wherein upon activation of a first team score button on said user interface, said microcontroller causes an audible serve warning tone to be sounded before a service, the microcontroller thereafter causing a game status to be announced if so required, and the microcontroller then causing the current score to be announced, and the microcontroller automatically increments the score if a serving team wins a point and thus again activates the first team score button, and the microcontroller announces side out as the game situation if a second team button on said user interface is activated, and said device includes means to manually override said microcontroller to correct a scoring error.

2. The volleyball scorekeeping device of claim 1 wherein:

said device includes means to remotely operate said user interface.

3. The volleyball scorekeeping device of claim 2 wherein:

said remote device is a wireless transmitter.

4. The volleyball scorekeeping device of claim 1 wherein:

said device includes means to trigger a quick score mode wherein a point is awarded on each serve.

5. The volleyball scorekeeping device of claim 1 wherein: said device includes means to select a number of points that will constitute a game.

6. The volleyball scorekeeping device of claim 1 wherein:

said device includes means to deliver at least two serve warning tones, a first tone being sounded for a first server on a serving team, and a second tone being sounded for a second server on said serving team.

7. The volleyball scorekeeping device of claim 1 wherein:

said device includes means to set a timer, and means to announce a time remaining on said timer.

8. The volleyball scorekeeping device of claim 1 wherein:

said device includes means to allow a waiting team to register for play by recording their name in registers of said addressable voice chip not occupied by said pre-recorded audible signals, said device further including means to announce registered waiting teams.

9. The volleyball scorekeeping device of claim 1 wherein:

said device includes a manual signup list.

10. The volleyball scorekeeping device of claim 1 wherein:

said device includes means to send a paging signal to a waiting player.

11. A volleyball scorekeeping device comprising:

a microcontroller, an addressable voice chip that an assembler pre-records with audible signals to track and score a volleyball game, a user interface including controls that a user operates to input information to said device, remote means to operate said user interface, and a speaker means to provide audible output; wherein upon activation of a first team score button, said microcontroller causes an audible serve warning tone to be sounded before a service, the microcontroller thereafter causing a game status to be announced if so required, and the microcontroller then causing the current score to be announced, and the microcontroller automatically increments the score if a serving team wins a point and thus again activates the first team score button, and the microcontroller announces side out as the game situation if a second team score button is activated, and said device includes means to manually override said microcontroller to correct a scoring error.

12. The volleyball scorekeeping device of claim 11 wherein:

said device includes means to trigger a quick score mode wherein a point is awarded on each serve.

13. The volleyball scorekeeping device of claim 11 wherein:

said device includes means to select a number of points that will constitute a game.

14. The volleyball scorekeeping device of claim 11 wherein:

said device includes means to deliver at least two serve warning tones, a first tone being sounded for a first server on a serving team, and a second tone being sounded for a second server on said serving team.

15. The volleyball scorekeeping device of claim 11 wherein:

said device includes means to set a timer, and means to announce a time remaining on said timer.

16. The volleyball scorekeeping device of claim 11 wherein:

said device includes means to allow a waiting team to register for play by recording their name in registers of said addressable voice chip not occupied by said prerecorded audible signals, said device further including means to announce registered waiting teams.

17. The volleyball scorekeeping device of claim 11 wherein:

said device includes a manual signup list.

18. The volleyball scorekeeping device of claim 11 wherein:

said device includes means to send a paging signal to a waiting player.

* * * * *